United States Patent [19]

Blumenthal

[11] 3,959,976

[45] June 1, 1976

[54] EXCAVATION-ROOF SUPPORT

[75] Inventor: Günter Blumenthal, Westerholt, Germany

[73] Assignee: Bochumer Eisenhutte Heintzmann & Company, Bochum, Germany

[22] Filed: Jan. 23, 1975

[21] Appl. No.: 543,369

[30] Foreign Application Priority Data

Mar. 21, 1974 Germany ..... 2413538

[52] U.S. Cl. ..... 61/45 D; 248/357

[51] Int. Cl.[2] ..... E21D 15/44

[58] Field of Search ..... 61/45 D; 299/31, 32, 299/33; 248/357; 91/170 MP

[56] References Cited

UNITED STATES PATENTS

| | | | |
|---|---|---|---|
| 3,779,023 | 12/1973 | Koppers | 61/45 D |
| 3,854,293 | 12/1974 | Spies | 61/45 D |
| 3,874,178 | 4/1975 | Kunzer | 61/45 D |

FOREIGN PATENTS OR APPLICATIONS

| | | | |
|---|---|---|---|
| 1,503,990 | 10/1967 | France | 61/45 D |
| 156,132 | 1/1964 | U.S.S.R. | 61/45 D |
| 208,621 | 7/1966 | U.S.S.R. | 61/45 D |
| 281,361 | 10/1971 | U.S.S.R. | 61/45 D |

*Primary Examiner*—Dennis L. Taylor
*Attorney, Agent, or Firm*—Michael J. Striker

[57] ABSTRACT

A base has one side facing towards and another side facing away from the face of the excavation. A shield has a first end portion and a second end portion, the latter being adjacent the other side and the shield extending upwardly and towards the one side. A roof-support cap is mounted on the first end portion. A mounting arrangement includes a shaft and mounts the second end portion of the shield on the base for pivoting about a pivot axis. A displacing arrangement serves to selectively displace the pivot axis in direction towards and away from the one side of the base, so as to maintain the cap in engagement with the roof despite different heights of the latter.

10 Claims, 4 Drawing Figures

EXCAVATION-ROOF SUPPORT

BACKGROUND OF THE INVENTION

The present invention relates to an excavation-roof support, such as is for instance used in mining applications.

Roof supports of this general type are well known, and are basically composed of a base from which a shield extends upwardly at one side towards the face of the excavation. The shield is supported by a pit prop or the like, and at its free end it carries a roof-supporting cap which is intended to bridge the distance between the face of the excavation and the base, since the base as a general rule cannot be moved close to the excavation face where space is required for conveyors or other equipment. In many instances, the height of the roof of an excavation will vary within a substantial range, for example in mining with the thickness of a vein of coal or the like may increase or decrease as a mining gallery is being driven deeper into the ground. This presents difficulties when, as already mentioned earlier, it is desired to maintain the front end of the roof supporting cap at a certain spacing from the face of the excavation, since the pivot axis between the free end of the shield and the cap is always located on an arc in the different elevational positions of the cap, which arc surrounds the pivot where the shield is mounted on the base. Since this pivot is usually relatively close to the floor of the excavation, it follows that, as the roof of the excavation recedes from the floor from point to point, the spacing between this pivot and the cap may vary widely, and consequently, the spacing between the front edge of the cap and the face of the excavation will similarly vary. Such support structures cannot, as pointed out earlier, be moved close to the face of the excavation because conveyors and other equipment must be located immediately adjacent the face, so that in areas where the roof is relatively high, there will be a very dangerous gap between the front edge of the roof supporting cap and the face, where the roof may break in since it is not supported by the cap.

The prior art has mostly proposed to provide separate supporting structures for each roof height in excavations, so that if the height of the roof of an excavation increased or decreased significantly, from a preceding location in the same excavation, a new support structure had to be brought in and installed.

A proposal in the prior art to accommodate a single support structure to varying roof heights required a construction which is difficult to use in actual operation, and is relatively complicated.

The need for a support structure of the type in question, capable of being adjusted in the manner suggested above, is therefore undiminished until now.

SUMMARY OF THE INVENTION

Accordingly, it is a general object of the present invention to provide an excavation-roof support structure of the type in question, which avoids the disadvantages of the prior art.

Another object of the invention is to provide such a support structure which can be readily and simply operated.

A further object of the invention is to provide such a roof structure which can quite precisely adjusted.

A further object of the invention is to provide such a support structure which can be accommodated to a wide range of different conditions.

In keeping with these objects and with others which will become apparent hereafter, one feature of the invention resides in an excavation-roof support structure comprising, briefly stated, a base having one side facing towards and an other side facing away from a face of the excavation. A shield has a first end portion and a second end portion which is located adjacent to the other side; the shield extends upwardly and towards the one side. A roof-support cap is mounted on the first end portion. Mounting means, including a shaft, mounts the second end portion of the shield on the base for pivoting about a pivot axis. Displacing means is provided for selectively displacing the pivot axis in direction towards and away from one side of the base so as to maintain the cap in engagement with the roof despite different heights of the latter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
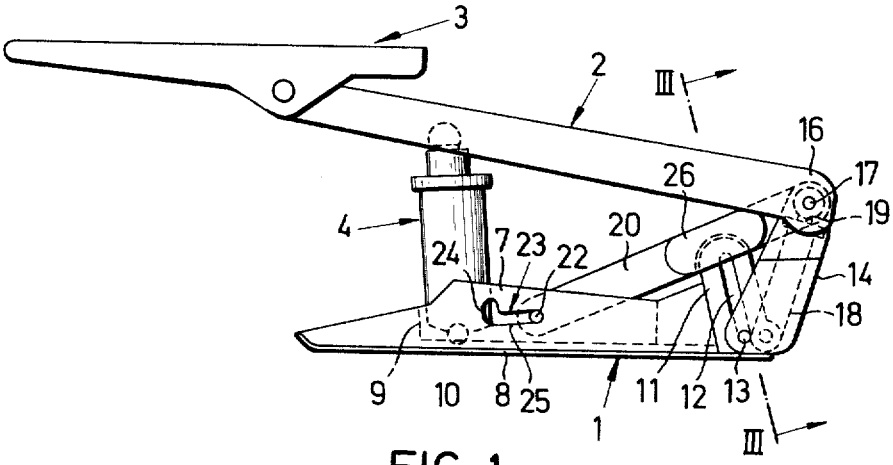
FIG. 1 is a diagrammatic side view of an apparatus according to the present invention, in downwardly retracted position.

FIGS. 1 – 4 illustrate a single exemplary embodiment of the invention. The apparatus disclosed therein is essentially composed of a base 1 having one side (FIG. 1 the left side) facing towards the (not illustrated) face of an excavation and another side facing oppositely of and away from the excavation. A shield 2 is mounted on the base 1 in the region of the other side and extends upwardly and toward the one side and carries at its free end portion a roof supporting cap 3. A support is provided for the shield 2 which can be raised and lowered, preferably in form of a hydraulic cylinder and piston unit 4, such as a pit prop or the like. The illustrated apparatus can be used by itself, or it can be used in combination with one or more similar apparatuses, for instance with two or three additional ones. If more than one such apparatus is utilized at the same time, it is conceivable for the cap 3 and/or the shield 2 and/or the base 1 of the several apparatuses to be integral or of one piece with one another, or are to be separate from one another. Those components which are then not so integrally connected can be articulated to one another for limited relative articulate displacement. The number of supports 4 would then correspond to the particular requirements, that is to the weight to be supported. A plurality of multiple-telescope supports 4 could be utilized or else cylinder and piston units having piston rods 5 provided with extensions 6 as suggested in FIG. 2.

In any case, in the illustrated embodiment the base 1 is hollow and essentially box shaped, being predominantly composed of vertical side plates 7 and a bottom plate 8 connecting these. In the direction towards the face of the excavation the base 1 tapers towards an essentially flat configuration and is closed at its upper side. The side plates 7 may be reinforced against bending and twisting over the entire length (in direction normal to the plane of FIG. 1) of the base. In the direction towards the left side facing the face of the excavation, in the region of an upwardly open portion 9, a support 10 for the element 4 is provided.

Figure 3:
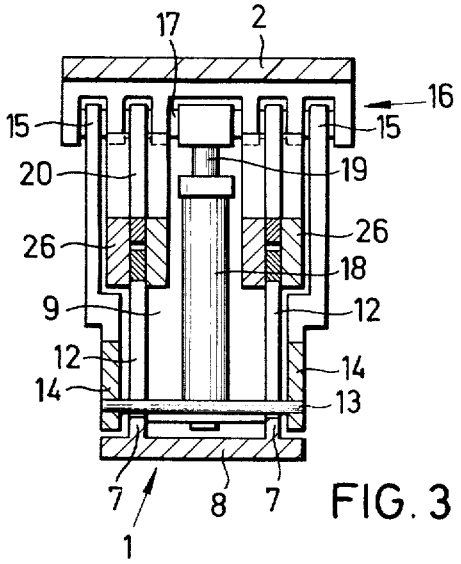
FIG. 3 is a section taken on line III—III of FIG. 1.

The drawing, particularly FIG. 3, clearly shows that the side plates 7 are offset towards the vertical longitudinal center plane by approximately the measure of their thickness in the right-hand region of the base 1 in FIG. 1, that is the one facing away from the face of the excavation. Portions 11 of the side walls 7 extend upwardly of the remainder of the base 1 and are rounded. Grooves formed as elongated slots 12 are provided in the longitudinal axis of these portions 11 which are inclined from vertical position towards the face of the excavation. Pivot pins 13, which are connected with plate-shaped guide members 14 that surround the portions 11 from the exterior, extend into the slots 12. The thickness of the members 14 corresponds approximately to the thickness of the side walls 7. In the upper region the members 14 are bent outwardly by approximately the amount of their thickness and with their upper end portions 15 they extend into a hinge-like end portion 16 of the shield 2, and are there pivoted at a pivot shaft 17 of the shield 2. The trailing end portion of the base 1, that is the side thereof facing away from the face of the excavation, serves further for tiltable mounting of a displacing arrangement, such as a hydraulically operating cylinder and piston unit 18 which is preferably located in the region of the vertical longitudinal center plane of the support structure. A piston rod 19 of the unit 18 also engages the pivot shaft 17.

Figure 4:
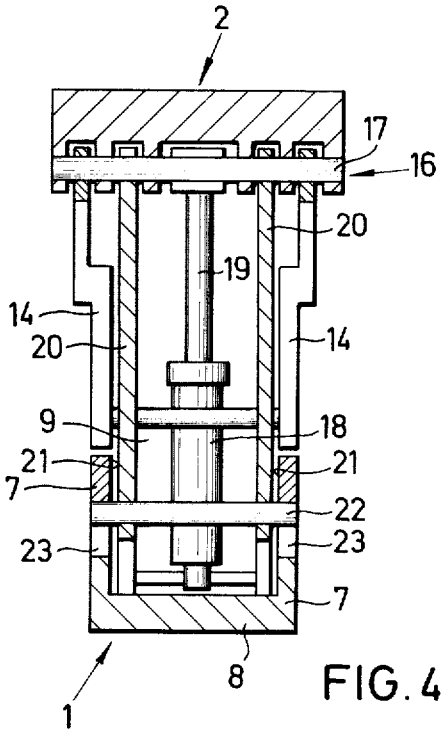
FIG. 4 is a section taken on line IV—IV of FIG. 2.

The end portion 16 of the shield 2 also serves to pivotably connect plate-like supporting members 20. As FIG. 4 shows particularly, these members 20 in form of straps engage into the upwardly open region 9 of the base 1 and are located adjacent inner surfaces 21 of the side walls 7. In the lower end region the members 20 are connected with one another by a bolt 22 which extends laterally beyond the outer surface of the members 20 and into cam grooves 23 that are formed in the side walls 7. These cam grooves 23 each have a convexly curved portion 24 which is adjoined by a straight portion 25 that inclines at a small angle towards the ceiling or roof. The cam grooves 23 may be constructed as elongated slots, and the bolt 22 may be secured in these grooves 23 against withdrawal therefrom.

The members 20 are provided in the region of the upper rounded end portions 11 of the base 1 with lateral reinforcements 26 which are shown in the drawing (including in FIG. 3). This is desirable since the members 20 at their lower ends are recessed corresponding to the rounding of the portions 11, in order to make it possible to lower the entire unit as much as possible if and when necessary.

Figure 2:
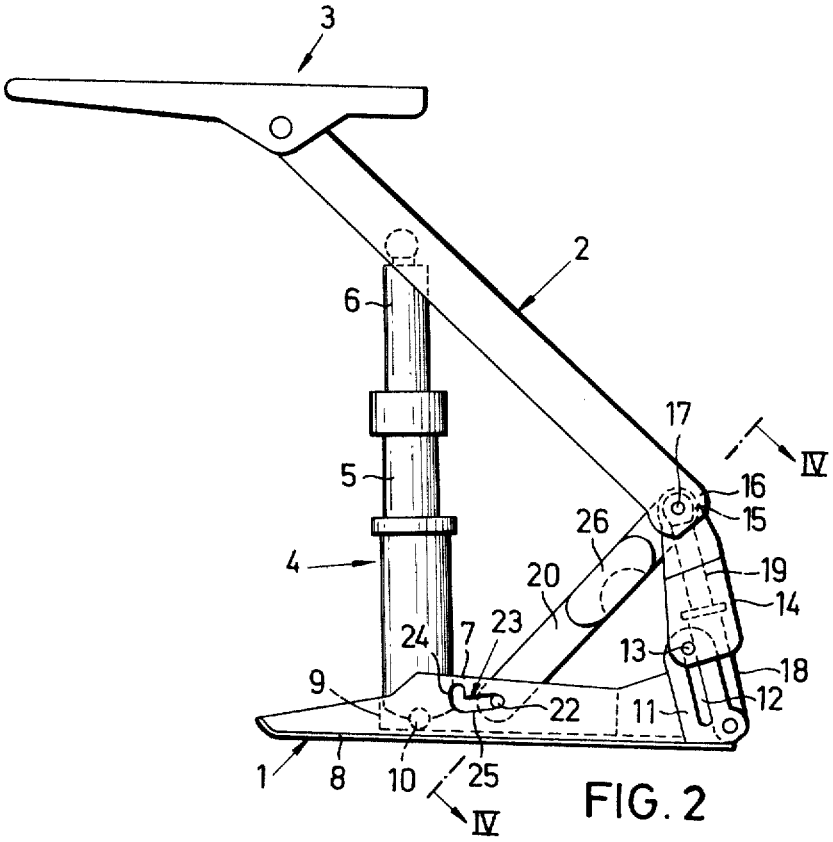
FIG. 2 is a view similar to FIG. 1 showing the apparatus in partially upwardly extended position.

FIGS. 1 and 2 show the unit in two different positions, and it will be clear from these Figures that the cylinder and piston unit 18 serves to displace the pivot shaft 17 in an arcuate path in the direction towards the face of the excavation, when the members 20 are retained by engagement of the bolt 22 with the grooves 23, so that the front edge of the cap 3 will always be located immediately adjacent to the face of the excavation despite the fact that the roof may have different heights. The pivots 13 slide during this movement in the slots 12 of the portions 11, which slots 12 are slightly inclined from the vertical towards the excavation face.

A movement of the lower end regions of the members 20 from the straight section 25 into cooperation with the curved sections 24 can be carried out if and when desired, by introducing the bolt 22 into these curved sections 24, in which case a further accommodation of the front edge of the cap 3 for movement closely adjacent to the face of the excavation can be obtained, in dependence upon the height to which the shield 2 and cap 3 have been erected. It is clear, therefore, that the members 14 and 20 form a support structure which, due to the displaceability of its base points on the base 1 makes possible a wide-ranging accommodation of the portion of the pivot 17 to the particular requirements encountered in an excavation.

The pivotal mountings for the members 14 and 20 may be so constructed that they can be displaceable only in direction between the two side edges of the base 1 (the left side edge and the right side edge in FIGS. 1 and 2), can be displaceable only in vertical direction, or can be displaceable in both directions and thus travel in a curved path. Appropriate means may be provided (not illustrated but known to those skilled in the art) for arresting them at certain locations, or at any locations along the path.

If a roof structure according to the present invention is, for example, used on an excavation having a low roof, the lower pivot 13 of the member 14 can be moved relative to the base 1 by the necessary amount in direction away from the excavation face and/or in direction towards the floor. This causes the pivot shaft 17 to be shifted in the same direction, and the pivot at which the shield 2 and the cap 3 are connected can then move to a position located within the safety region or vector that is formed by a transverse plane that extends in vertical direction through the left-hand side of the base 1 in FIG. 1, and a further plane which is inclined in the direction towards the excavation face relative to the first-mentioned plane through approximately 10° and also passes through the left-hand side of the base 1. If the axis about which the cap 3 can pivot relative to the shield 2 is located forwardly of this vector in direction towards the excavation face, it is outside the safety range and the structure then tends to tilt in counterclockwise direction in FIG. 1.

If the support structure of the present invention is to be used in an excavation having a higher roof than in the previously described example, then the pivot axis connecting the cap 3 and the shield 2 will tend to recede (towards the right in FIG. 1) from the excavation face as the shield 2 is moved to a more upright position, due to the arcuate path which this pivot axis describes during such movement. An appropriate movement of the pivots 13 connecting the members 14 with the base 1, relative to the base 1 in direction towards the excavation face (and if desired also towards the roof) causes the pivot axis where the cap 3 is connected to the shield 2 to again become displaced towards the excavation face, whereby the front edge of the cap 3 becomes again located close to the excavation face.

Of course, the pivot 22 where the members 20 are connected to the base 1 may either be fixed or, as previously already described, may itself be shiftable and arrestable. This latter possibility has the added advantage that it permits a very precise selection of the position of the front edge of the cap 3 with reference to the excavation face. A particularly advantageous and currently preferred embodiment utilizes the possibility already described, namely that the pivot where the members 14 are connected with the base 1, can be raised or lowered. The use of the hydraulic cylinder and piston unit 18 described for effecting this displacement is especially advantageous.

By having the longitudinal guide grooves or cam grooves 23 for the members 20 formed in the side walls of the base 1, the members 20 can be lowered particularly extensively, so that the shield 2 can similarly be lowered and this facilitates the movement of the apparatus through low mining galleries or the like. It also permits, of course, the use of the apparatus in excavations having a low ceiling. The cam grooves 23 need not have the two-section configuration described with respect to FIGS. 1 – 4, but can also be differently shaped although this particular construction has been found to be especially advantageous.

The arrangement of the device 4 is always such that the device 4 is inclined at least slightly in direction toward the excavation face, irrespective of how high the shield 2 has been raised or how long it has been lowered. This assures that the device 4 will have transmitted to it from the shield 2 a force component acting in direction towards the excavation face, so that the base 1 is thereby relieved to some extent and can be constructed less sturdily and lighter than would otherwise be possible, which is especially advantageous for underground handling of such equipment. The arrangement of the cam grooves assures an appropriate positioning of the shield 2 and therefore of the cap 3 even if they are not arrested as long as the device 4 is in its forward and rearward end positions that it can assume.

It will be understood that each of the elements described above, or two or more together, may also find a useful application in other types of constructions differing from the types described above.

While the invention has been illustrated and described as embodied in an excavation-roof support structure, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A roof support for use in underground excavations of different roof heights, comprising a base having one side facing towards and another side facing away from a face of the excavation; a shield having a first end portion spaced from and another end portion adjacent said other side, and extending upwardly of said base; a roof support cap mounted on said first end portion of said shield; means for connecting said second end portion of said shield to said base, including at least one guide member and at least one support member each having a first portion remote from and a second portion at said base, a pivot shaft mounted on said first portions of said members and articulating the same to one another, and means for mounting said second portions of said members on said base for pivoting about spaced axes, and at least one of said second portions for selective displacement relative to said base to thereby change the position of said pivot shaft with respect to said base, said second end portion of said shield being supported on said pivot shaft so that said displacement of the latter results in commensurate displacement of the former, and for pivoting about said pivot shaft; means for pivoting said shield about said pivot shaft and including a pit prop extending between and engaging said base and said shield; and means for selectively infinitely displacing said pivot shaft with respect to said base in dependence on the instantaneous roof height so as to maintain said cap in engagement with the roof close to the face of the excavation for each instantaneous roof height.

2. A roof support as defined in claim 1, wherein said guide member is pivoted to said base at a joint; and wherein said joint is mounted for movement in an upright path relative to said base.

3. A roof support as defined in claim 2; said displacing means comprising a cylinder and piston unit having opposite ends which respectively bear upon said shaft and said base for effecting said displacement.

4. A roof support as defined in claim 3, wherein said joint comprises support portions on said base and formed with guide grooves, and pins on said guide member and slidably and pivotably received in the respective guide grooves.

5. A roof support as defined in claim 1, said support member comprising two plates transversely spaced from each other and each located outwardly adjacent to one of the lateral faces of said face, said plates having lower end regions which are wider than their upper end regions.

6. A roof support as defined in claim 5, wherein said upper end regions have end portions which are bent outwardly by an amount substantially equal to the thickness of said plates.

7. A roof support as defined in claim 1, wherein said support member is mounted on said base for shifting movement to a plurality of positions in each of which it is arrestable.

8. A roof support as defined in claim 7, wherein said support member comprises two substantially parallel strap members, and transversely extending pins; said base having curved cam track means direction and engaged by said pins.

9. A roof support as defined in claim 8, said base including lateral side walls having inner surfaces; and wherein said straps are spaced from one another and are each in part juxtaposed with one of said inner surfaces.

10. A roof support as defined in claim 8, wherein said cam track means includes a pair of cam tracks each having a convexly curved portion extending in direction away from said excavation face, and a straight-line portion extending from said curved portion and rising therefrom at a slight angle also in direction away from said excavation face.

* * * * *